US005975935A

United States Patent [19]

Yamaguchi et al.

[11] Patent Number: 5,975,935

[45] Date of Patent: Nov. 2, 1999

[54] ASSEMBLING STRUCTURE FOR INSTALLING ELECTRICAL APPLIANCE MODULE

[75] Inventors: Atsuyoshi Yamaguchi; Minoru Kubota; Mitsuaki Morimoto; Yoshihito Aoki, all of Shizuoka, Japan

[73] Assignee: Yazaki Corporation, Tokyo, Japan

[21] Appl. No.: 08/773,375

[22] Filed: Dec. 26, 1996

[30] Foreign Application Priority Data

Dec. 28, 1995 [JP] Japan ..... 7-343971
Jul. 2, 1996 [JP] Japan ..... 8-172593

[51] Int. Cl.[6] ..... H01R 33/00

[52] U.S. Cl. ..... 439/374; 439/929

[58] Field of Search ..... 439/374, 929, 439/34, 545, 533, 354

[56] References Cited

U.S. PATENT DOCUMENTS

| | | | |
|---|---|---|---|
| 5,145,385 | 9/1992 | Takano | 439/374 |
| 5,382,179 | 1/1995 | Noschese | 439/533 |
| 5,589,715 | 12/1996 | Nishitani et al. | 439/34 |
| 5,627,409 | 5/1997 | Nishitani | 439/34 |
| 5,743,755 | 4/1998 | Aoki | 439/354 |

FOREIGN PATENT DOCUMENTS 7-96774 4/1995 Japan .

*Primary Examiner*—Paula Bradley
*Assistant Examiner*—Tho D. Ta
*Attorney, Agent, or Firm*—Armstrong, Westerman, Hattori, McLeland & Naughton

[57] ABSTRACT

A mounting structure for installing an electrical appliance module for mounting on the vehicle on board equipment of the instrument panelboard of the automobile wherein the connection of the connector of the wire harness of the body side is performed reliably and smoothly. There are provided a connector accommodating section B for the instrument panel P as the vehicle on board equipment, and a module mounting section 13 for the receptive connector C. The module mounting section 13 allows the receptive connector C to mount on the connector accommodating section B, and it allows the introducing projection 14 of the receptive connector C to insert into the fitting groove 3 provided at the electrical appliance module A. The electrical appliance module A can thus be assembled to the instrument panel, and the terminal of the electrical terminal receptive connector C of the electrical appliance module A is connected to the instrument panel.

10 Claims, 21 Drawing Sheets

A3
36''
37
55
25
24
27
23
22b
22a
30
22

22a
29
29'
22b
28

ASSEMBLING STRUCTURE FOR INSTALLING ELECTRICAL APPLIANCE MODULE

BACKGROUND OF THE INVENTION

1. Field of the Invention

The present invention relates to an assembling structure for installing an electrical appliance module to a vehicle body and, more particularly, to the assembling structure for installing the electrical appliance module in which switches, lamps, measuring instruments, and control circuits therefor are integrally assembled therewith, in order to mount them on a vehicle on board equipment such as an instrument panel section or a roof section of the automobile. Here, the electrical appliance module is an electrical appliance member consisting of the switches, the lamps, and the measuring instruments and electronic functional parts and flexible printed wiring board for controlling these switches, lamps, and measuring instruments.

2. Description of the Prior Art

An electrical circuit of the instrument panel for the automobile comprises wire harnesses formed in accordance with the given electrical circuit. The wire harnesses are arranged at a body of the automobile or the instrument panel by the manual operation. The circuit is formed in such a way that connectors of the wire harnesses are connected to the switches and connectors of the measuring instruments.

On the other hand, electronic parts are used in an automobile, and electrical control is highly improved, thereby in the instrument panel provided in front of the driver's seat, the density of switches and measuring instruments is increased. The electrical circuits are complicated. The number of wire harnesses which are employed for the circuit construction thereof is greatly increased, and the weight thereof also greatly increased. They are incapable of being installed into the limited space. The assembling operations are very troublesome and inefficient.

As shown in FIGS. 21 and 22, a meter module M is proposed by the Japanese Patent Application Laid-Open No. Hei 7-96774 in which the electrical circuit of the instrument panel is simplified.

The meter module M comprises a measuring instrument panel on which meter display lamps or the like and driving circuit thereof are mounted, a power supply corresponding to vehicle electrical appliance members including the meter display lamps, an electrical junction box b in which a functional circuit for controlling distribution of input/output signals and controlling thereof is assembled, a cluster module d which is integrally connected together to the switch unit c including switches of the vehicle electrical appliance members, and a finish panel e mounted in front of the cluster module d.

The meter module M is mounted on a given portion of the instrument panel f. The meter module M is electrically connected to the wire harness g in such a way that the connector h connected to the wire harness within the vehicle is joined with the connector i connected to the meter module M.

However, in this meter module M, when the distance between the connector h of the wire harness g and the connector i of the side of the meter module M is long, a position deviation between the connector h and the connector i becomes large depending on the distance therebetween. Even if the expensive movable connector is adopted, it is difficult to perform the connection between the connector h and the connector i with the position deviation collected. There is the problem that the operability thereof is remarkably reduced.

Further, also in the relative large-type car such as a recreational vehicle ("RV") car, a large-type roof is employed and a large-type electrical appliance member such as air conditioner, a television, a room lamp, sun roof and so forth are installed thereon, thereby in the wire harnesses for connecting thereof, and arrangement thereof and connecting operation for the connector, there are the same problems as that of the instrument panel.

SUMMARY OF THE INVENTION

In view of the foregoing, it is an object of the present invention to provide an assembling structure for installing an electrical appliance module wherein in which an electrical appliance module such as a meter module is assembled to a vehicle on board equipment such as an instrument panel, the connection between a connector of the vehicle body side and a connector of the electrical appliance module is securely and smoothly performed, and the operability of the assembling process is greatly improved.

According to one aspect of the present invention, for achieving the above-mentioned object, there is provided an assembling structure of an electrical appliance module including switches, lamps or measuring instruments therefor, and an electrical circuit for controlling the switches, the lamps or the measuring instruments, being assembled to a vehicle on board equipment such as an instrument panel, and to which a receptive connector of a wire harness is connected, the assembling structure of the electrical appliance module comprises a connector accommodating section provided at the vehicle on board equipment, a module mounting section provided at a connector case of the receptive connector, a coupling section to the receptive connector at the case of the electrical appliance module, and a guide member for engaging with the module mounting section, wherein it allows the receptive connector to mount on the connector accommodating section, and it allows the guide member of the electrical appliance module to insert into said module mounting section, thereby said electrical appliance module can be assembled to the vehicle on board equipment, and a terminal provided at the coupling section of the electrical appliance module can come into contact with a terminal of the receptive connector.

Further, there is provided an assembling structure of an electrical appliance module, wherein the vehicle on board equipment is an instrument panel.

Furthermore, there is provided an assembling structure of an electrical appliance module, wherein the vehicle on board equipment is a unit case of a roof air conditioner unit which is fixed to the body roof section.

Moreover, there is provided an assembling structure of an electrical appliance module, wherein the connector accommodating section equips a guide projection, and a connector case of the receptive connector equips a guide groove, caused by the fact that the guide projection is inserted into the guide groove, the receptive connector is fixed to the connector accommodating section.

Moreover, there is provided an assembling structure of an electrical appliance module, wherein a module mounting section of the receptive connector is formed as a board shaped introducing projection, and a guide member of the electrical appliance module is formed as an inserting groove for receiving the introducing projection, as the introducing projection enters into an inserting groove, prior to connection-start between the receptive connector and the coupling section, the introducing projection is projected to be formed in front of the connector case.

Moreover, there is provided an assembling structure of an electrical appliance module, wherein the guide member of the electrical appliance module is formed as the board shaped introducing projection, and the module mounting section of the receptive connector is formed as a fitting hole for receiving the introducing projection, as the introducing projection enters into the fitting hole, prior to connection-start between the receptive connector and the coupling section, the introducing projection is projected to be formed in front of the case of the electrical appliance module.

Moreover, there is provided an assembling structure of an electrical appliance module, wherein the guide groove of the receptive connector is a guide groove having a tapered section which extends toward the coupling section of the connector accommodating section.

Moreover, there is provided an assembling structure of an electrical appliance module, wherein the receptive connector mounts a plurality of surface-contact type terminals on the upper wall of the connector case, and the electrical appliance module equips surface-contact type electrical terminal with an elastic contact piece on the coupling section provided at the case.

Moreover, there is provided an assembling structure of an electrical appliance module, wherein the receptive connector is formed as a male type connector receiving female terminals, and the coupling section of the electrical appliance module is formed as a female type connector receiving male terminals corresponding to the female terminals.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the invention will now be described in detail referring to the accompanying drawings.

Figure 1:
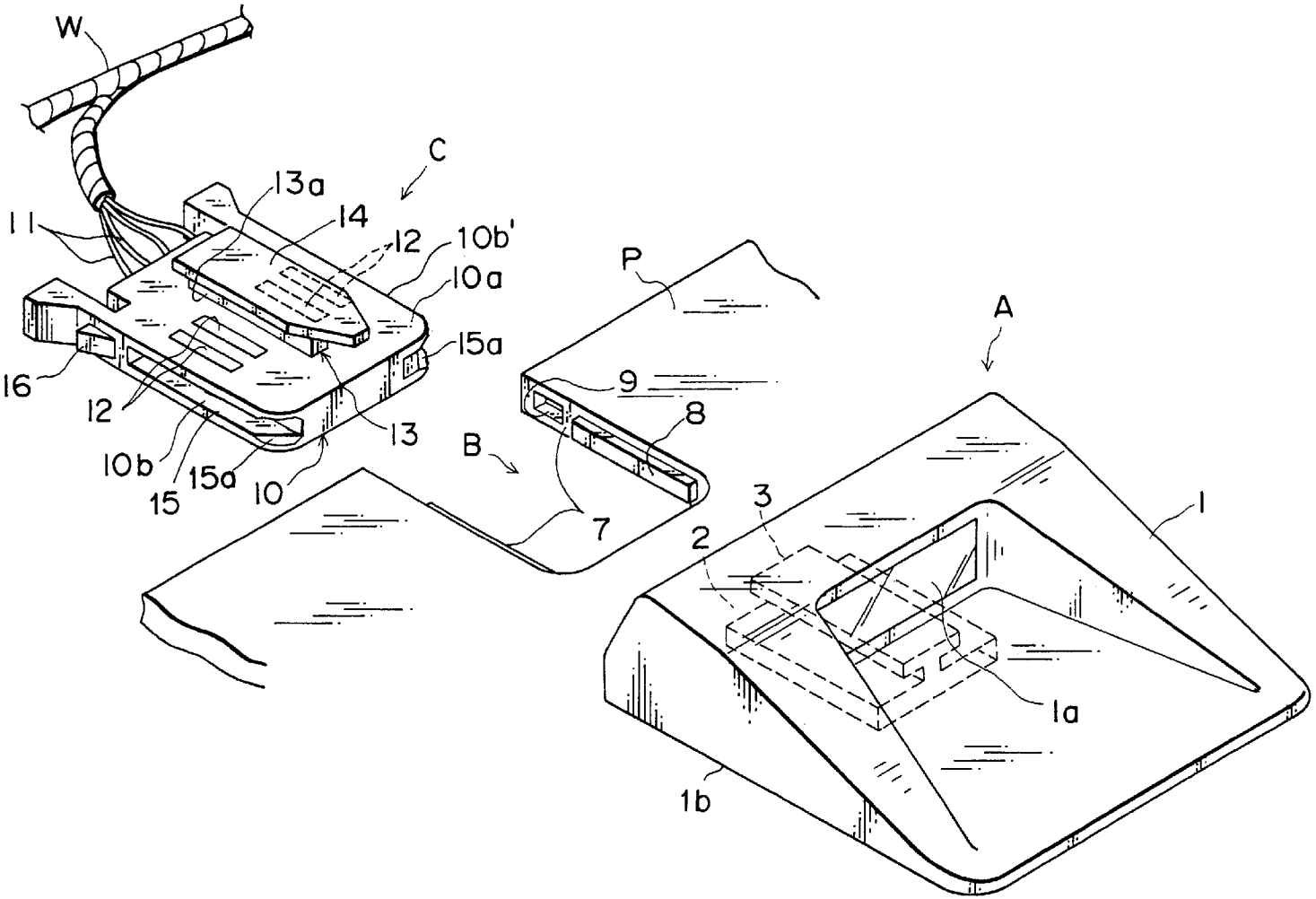
FIG. 1 is a perspective view showing a receptive connector connected to a branch line of a body side wire harness and a connector accommodating section provided for a dash board and an electrical appliance module according to the present invention.

FIG. 1 shows an electrical appliance module A, a connector accommodating section B provided at the instrument panel P, and a receptive connector C connected to the branch wire of the wire harness W of the body side according to the embodiment of the present invention.

The electrical appliance module A is a display-unit. The equipment such as the digital watch and so forth are mounted on the inside of the case 1 which is made of synthetic resin. Information, for example the time is indicated at an indicating section la of the electrical appliance module. A coupling section 2 is provided at the bottom wall 1*b* of the case 1. The coupling section 2 is connected to the receptive connector C.

Figure 2A:
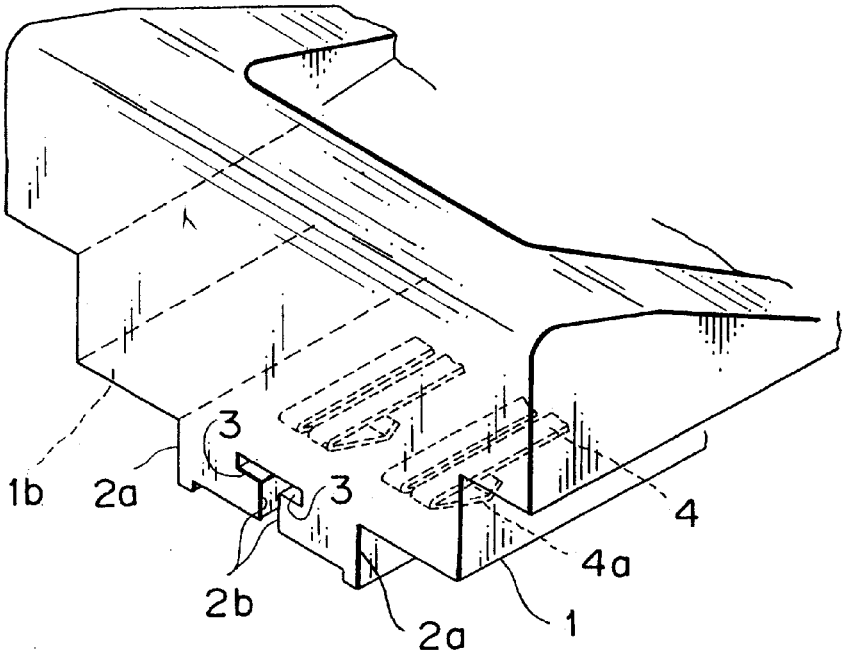
FIG. 2A is a perspective view showing a coupling section of the electrical appliance module of FIG. 1.

The coupling section 2 is shown in FIG. 2A. Both side walls 2*a*, 2*a* stand from the bottom wall 1*b* of the case 1. On the inside of the side walls 2*a*, 2*a*, intermediate walls 2*b*, 2*b* are provided in parallel with the bottom wall 1*b* of the case 1. A gap is provided between the intermediate walls 2*b*, 2*b* and the bottom wall 1*b*. Thereby, inserting grooves 3, 3 which has T shaped section are formed to the receptive connector C.

Figure 3:
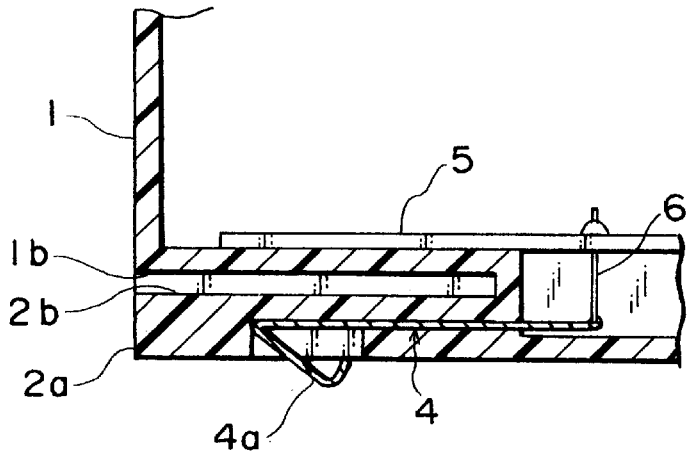
FIG. 3 is a sectional view showing a structure of an electrical terminal arranged at the coupling section of FIG. 2A.

A surface contacting type electrical contact 4 is attached to the intermediate wall 2*b*. The electrical contact 4 is provided with an elastic contact piece 4*a*. As shown in FIG. 3, the electrical contact 4 is connected to a printed circuit body 5 on the inside of the case 1 through the connecting wire 6.

FIG. 2A shows an example of coupling section 2. Both side walls 2*a* is protruded at the bottom wall 1*b* of the case 1. An intermediate wall 2*b* is provided at each side wall 2*a*. The inserting groove 3 is formed in the T shaped section, and an electrical contact 4 is attached to the bottom surface of the intermediate wall 2*b*.

Figure 2B:
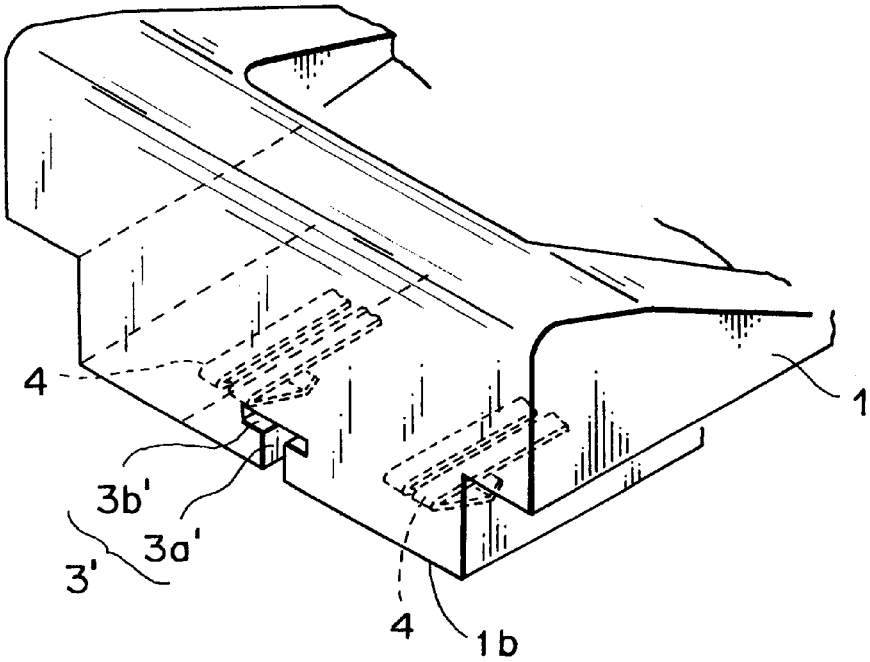
FIG. 2B is a perspective view showing a coupling section of another embodiment.

As shown in FIG. 2B, another example of the coupling section 2 is shown. An inserting groove 3' is formed in such away that a slit-type perpendicular groove 3*a*′ and following lateral groove 3*b*′ are directly provided at the bottom wall 1*b* of the case 1. The electrical contact 4 is attached to the bottom wall 1*b* positioned on the both side of the perpendicular groove 3*a*′. The connector accommodating section B is provided at the rear section of the instrument panel P for accommodating the receptive connector C. Guide projection 8, 8 are provided at the both side walls 7,7. A locking hole 9 is formed at the end section of the both side walls 7, 7.

Figure 4:
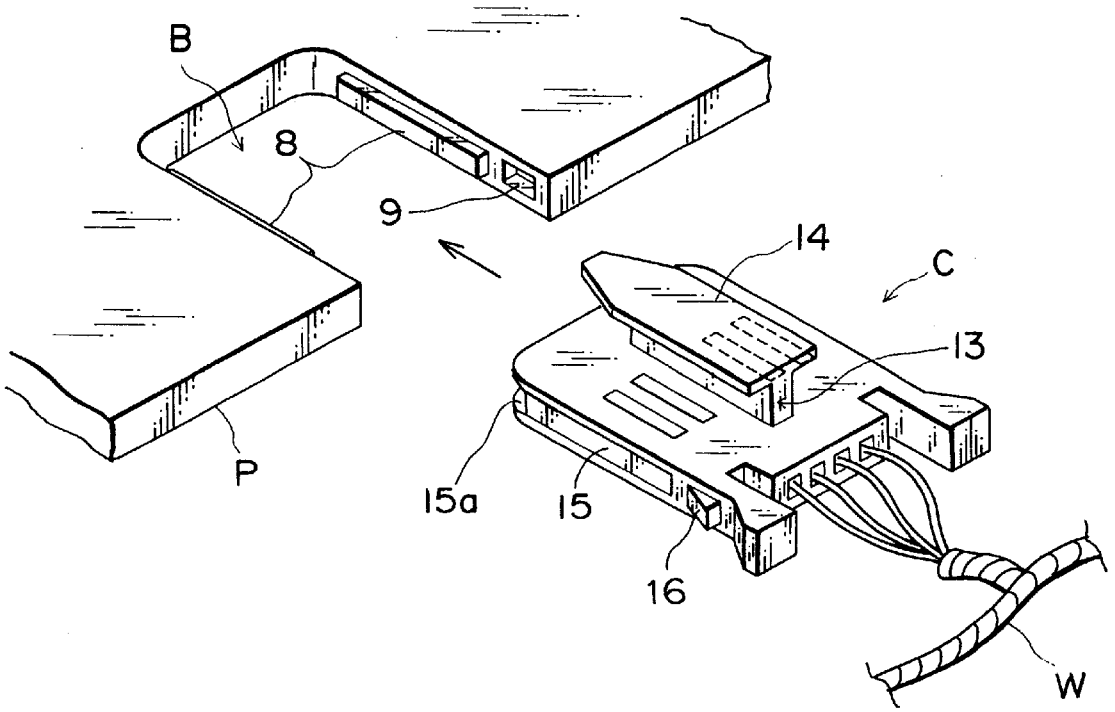
FIG. 4 is a view showing a process where it render the receptive connector to mount to the connector accommodating section of FIG. 1.

As shown in FIG. 4, the receptive connector C receives the branch wires 11 branched from the wire harness W on the inside of the connector case 10 formed in the plate-shape. A plurality of surface contacting type terminals 12 connected to the branch wires 11 are arranged in the upper wall 10*a*.

A module mounting section 13 in which the electrical appliance module A is fitted is projected at the upper wall 10*a* of the connector case 10. A board shaped introducing projection 14 is provided at the upper section of the base section 13. The introducing projection is in the shape that the pointed end is sender. The introducing projection 14 is joined with the electrical appliance module A by inserting the introducing projection 14 into the inserting groove 3 of the electrical appliance module A. Guide grooves 15 for receiving the guide projection 8 of the connector accommodating section B of the instrument panel P are formed on both side walls 10*b*, 10*b*′ of the connector case 10. Taper section 15*a*, 15*a* which expands toward the coupling side are formed in front of the both guide groove 15 (coupling side). A locking projection 16 which is engaged with the locking hole 9 of the connector accommodating section B is provided at the rear end section of the both side walls 10*b*, 10*b*′.

Next, Assembling method of the electrical appliance module A will be described. The electrical appliance module A is assembled in such a way that it allows the receptive connector to insert into the connector accommodating section B of the instrument panel P.

In the first place, as shown in FIG. 4, it allows the guide groove 15 of the receptive connector C to meet to the guide projection 8 of the connector accommodating section B, thus pushing the receptive connector into the arrow direction. The receptive connector advances into the connector accommodating section B, and the locking hole 9 engages with the locking projection 16, before the receptive connector C is fixed to the instrument panel P. At this time, since the taper section 15*a* is formed at the guide groove 15, the positions of both sections are easy to determine and the insertion is performed easily.

Figure 5:
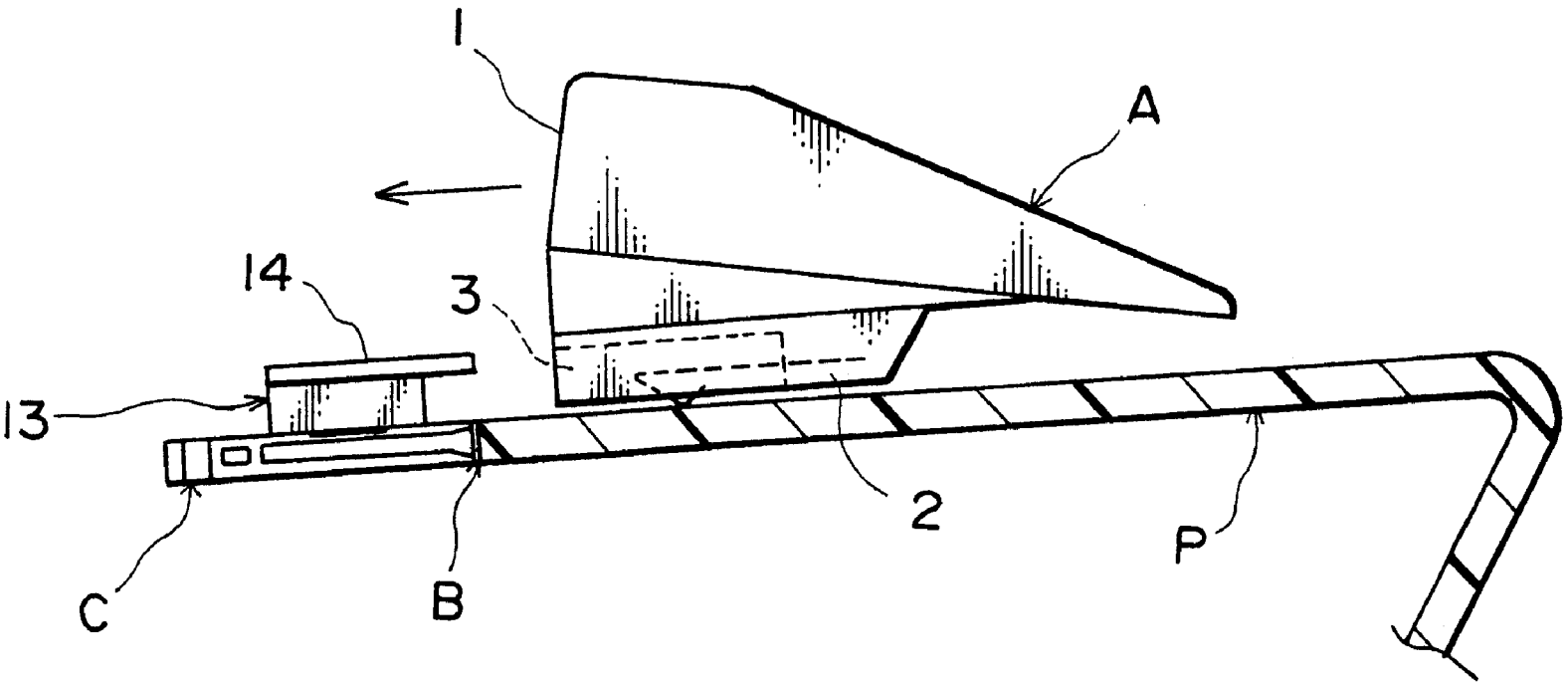
FIG. 5 is a view showing a process where it allows the electrical appliance module to assemble to the receptive connector being mounted on the connector accommodating section of FIG. 4.
Figure 6:
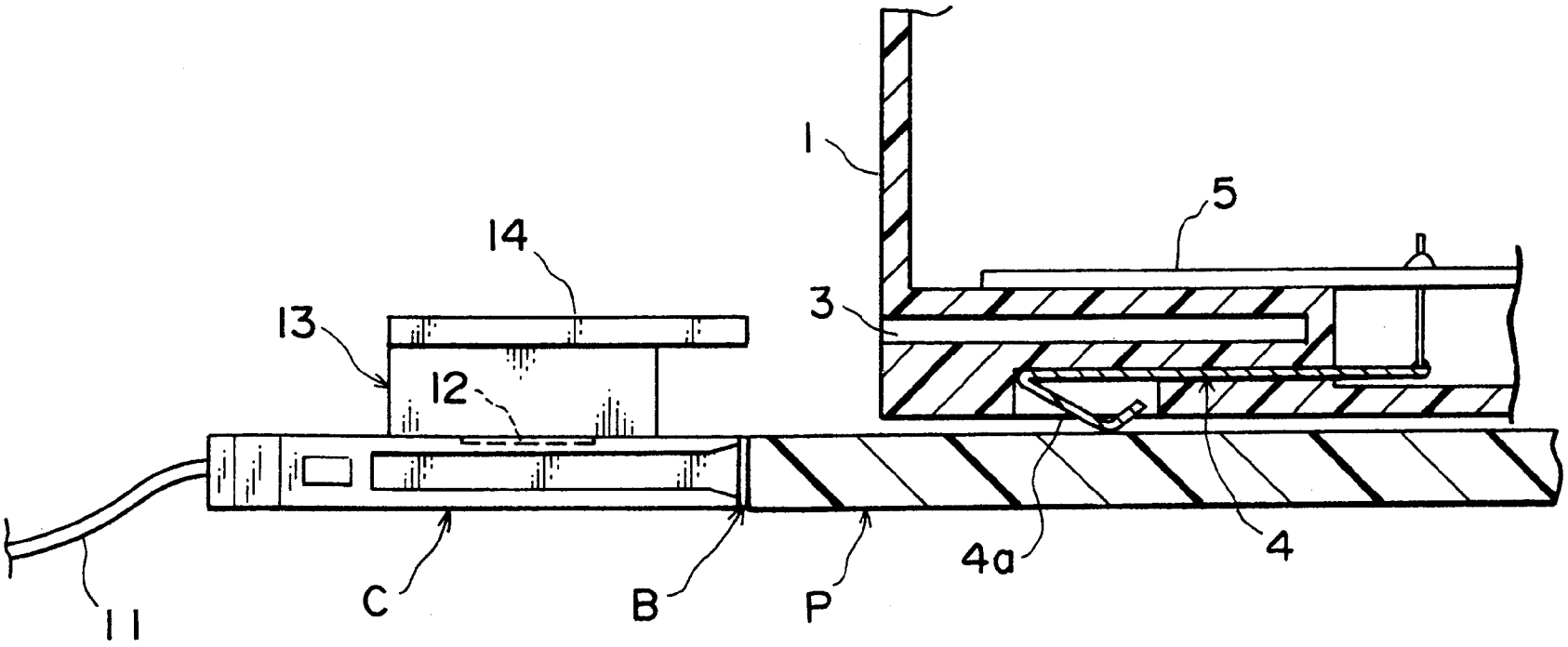
FIG. 6 is a view showing a coupling process between the electrical appliance module and the receptive connector of FIG. 5.

Secondly, as shown in FIGS. 5 and 6, the electrical appliance module A is placed on the instrument panel P. The electrical appliance module A is so positioned that the pointed end of the introducing projection 14 of the module mounting section 13 of the receptive connector C is matched to the inserting groove 3 of the coupling section 2 of the electrical appliance module A.

Figure 7:
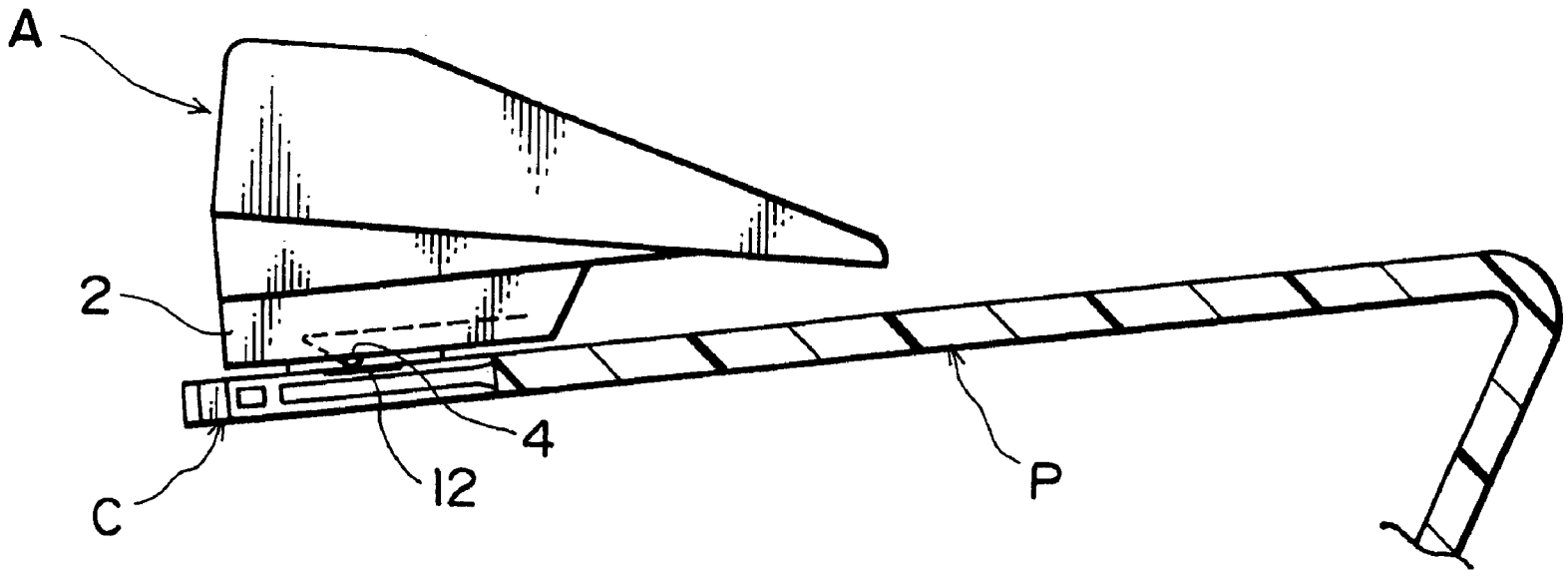
FIG. 7 is a view showing an integrated condition where it allow the electric appliance module to mount to the waiting connector of FIG. 5.

It allows the electrical appliance module A to push toward the arrow direction of FIG. 5. The introducing projection 14 of the module mounting section 13 enters into the inserting groove 3. As shown in FIG. 7, the receptive connector C and the electrical appliance module A are integrally fastened. The terminal 12 of the receptive connector C comes into contact with the elastic contact piece 4*a* of the electrical contact 4 of the electrical appliance module A, thus the both electrically contacting.

Figure 8:
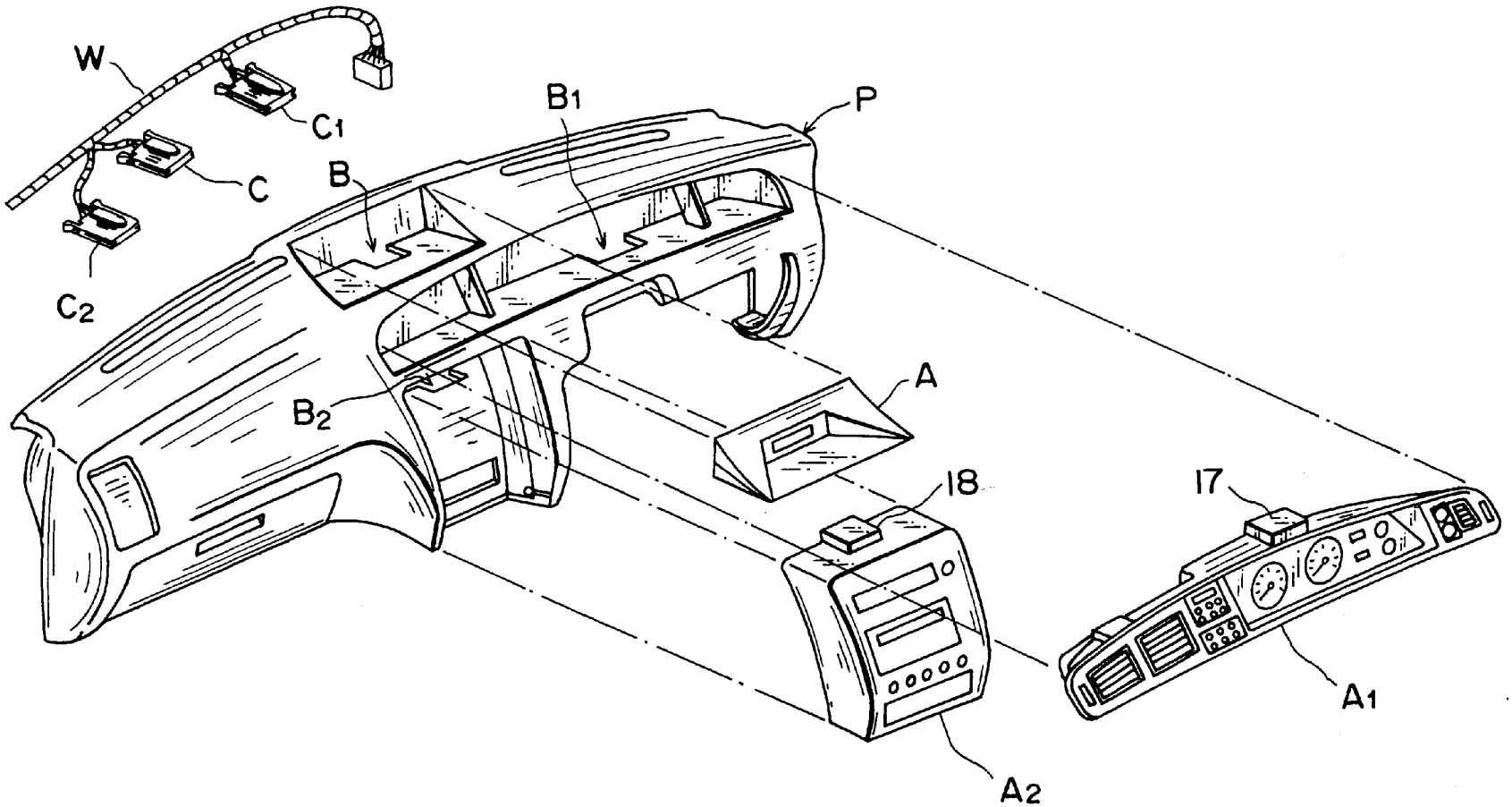
FIG. 8 is a view showing various kinds of electrical appliance module concerning the another embodiments of the present invention.

In the above embodiment, the case of assembly of the display unit is described as the electrical appliance module. The present invention is not restricted the case of the display unit. As shown in FIG. 8, a driver cluster unit in which meter and switch or the like are mounted is constituted as the electrical appliance module $A_1$, and the coupling section 17 which is the same as that of the electrical alliance module A. The connector accommodating section $B_1$ is provided at the instrument panel P, and if the connector accommodating section $B_1$ is connected to the wire harness W through the receptive connector $C_1$ which has the same structure as the receptive connector C, the electrical appliance module $A_1$ is easy connected to the receptive connector similar to the electrical appliance module A.

Further, a center cluster unit in which there exist an operating section of an air conditioner and an audio appliance is constituted as the electrical appliance module $A_2$, the coupling section 18 which is the same as that of the electrical alliance module A is attached thereto. The electrical appliance module $A_2$ is easy to assemble to the connector accommodating section $B_2$ and the receptive connector $C_2$ provided at the instrument panel P similar to the case of the electrical appliance modules A, $A_1$.

Figure 9:
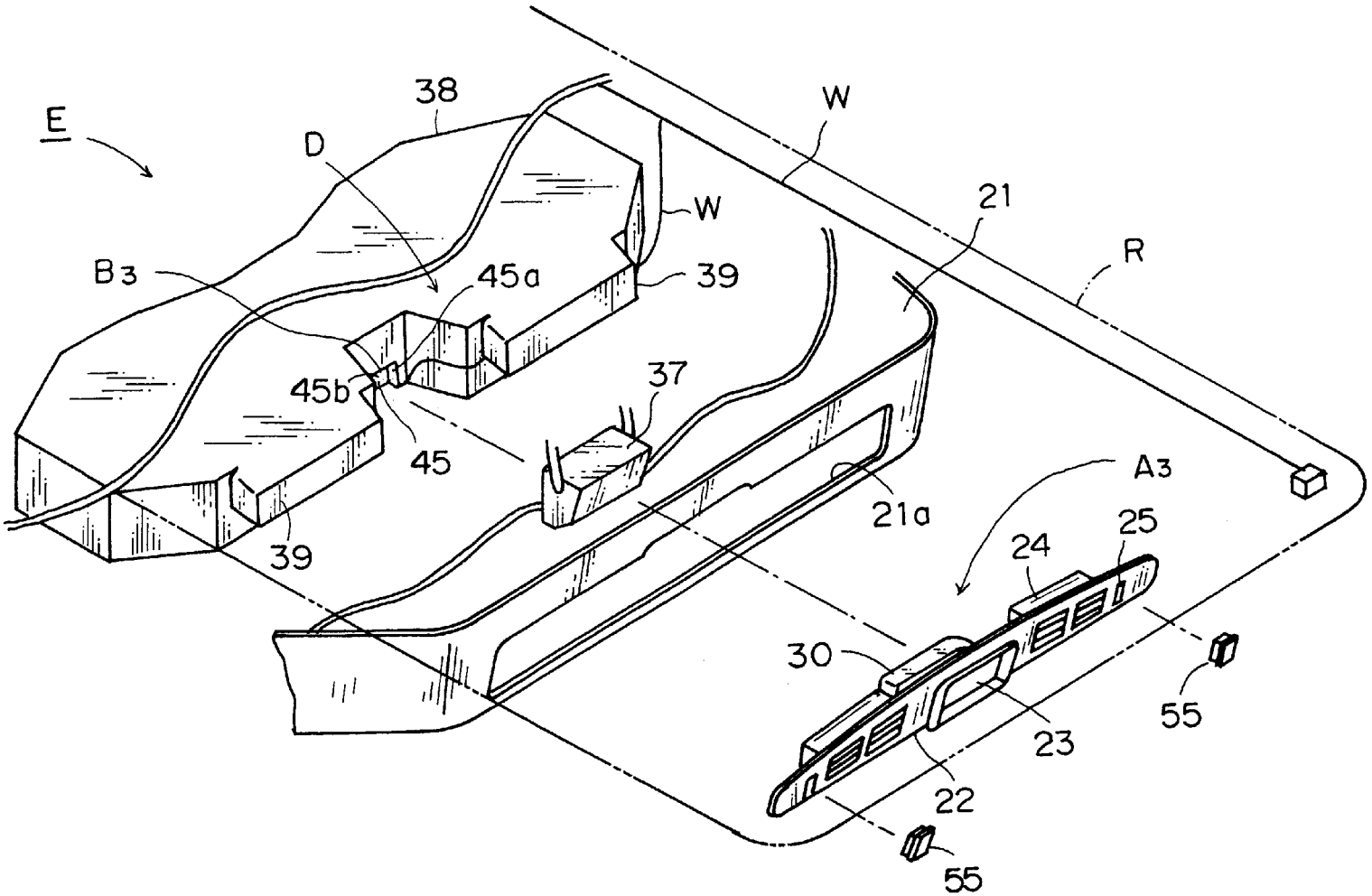
FIG. 9 is a perspective view showing a separated condition where the assembly structure of the electrical appliance module of the present invention is applied to the roof air conditioner of the body roof section.
Figure 10:
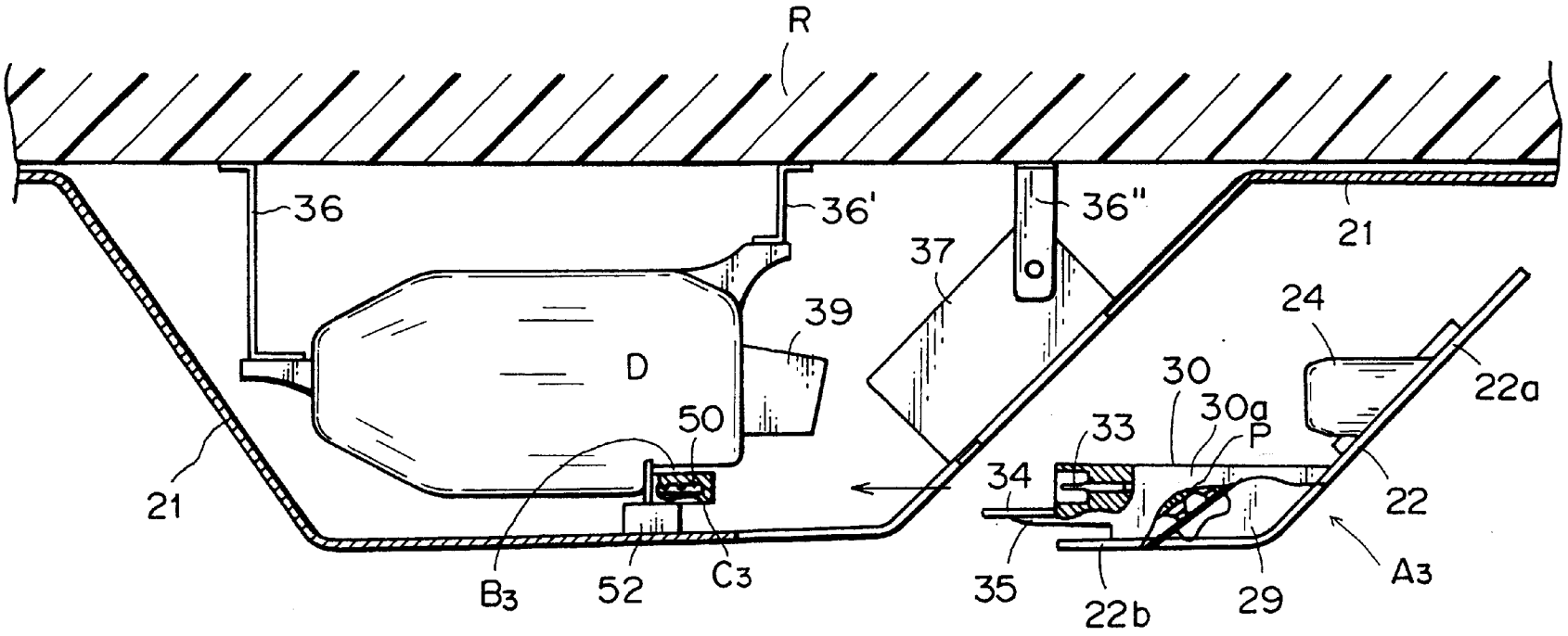
FIG. 10 is a sectional view showing a partial assembly condition of FIG. 9.

FIG. 9 is a perspective view showing the separated condition where the assembly structure of the electrical appliance module of the present invention is adapted to the roof air conditioner of the body roof section. FIG. 10 is a sectional view showing a part-assembly condition thereof.

In FIGS. 9 and 10, E designates a roof air conditioner assembling body. The roof air conditioner E comprises an electrical appliance module A3, a roof air conditioner unit D arranged on the inside of the mold-roof 21 of the body roof section R, a connector accommodating section $B_3$ provided at the unit D, and a receptive connector $C_3$ connected to the roof wire harness of the body side and so forth.

Figures 11A, 11B:
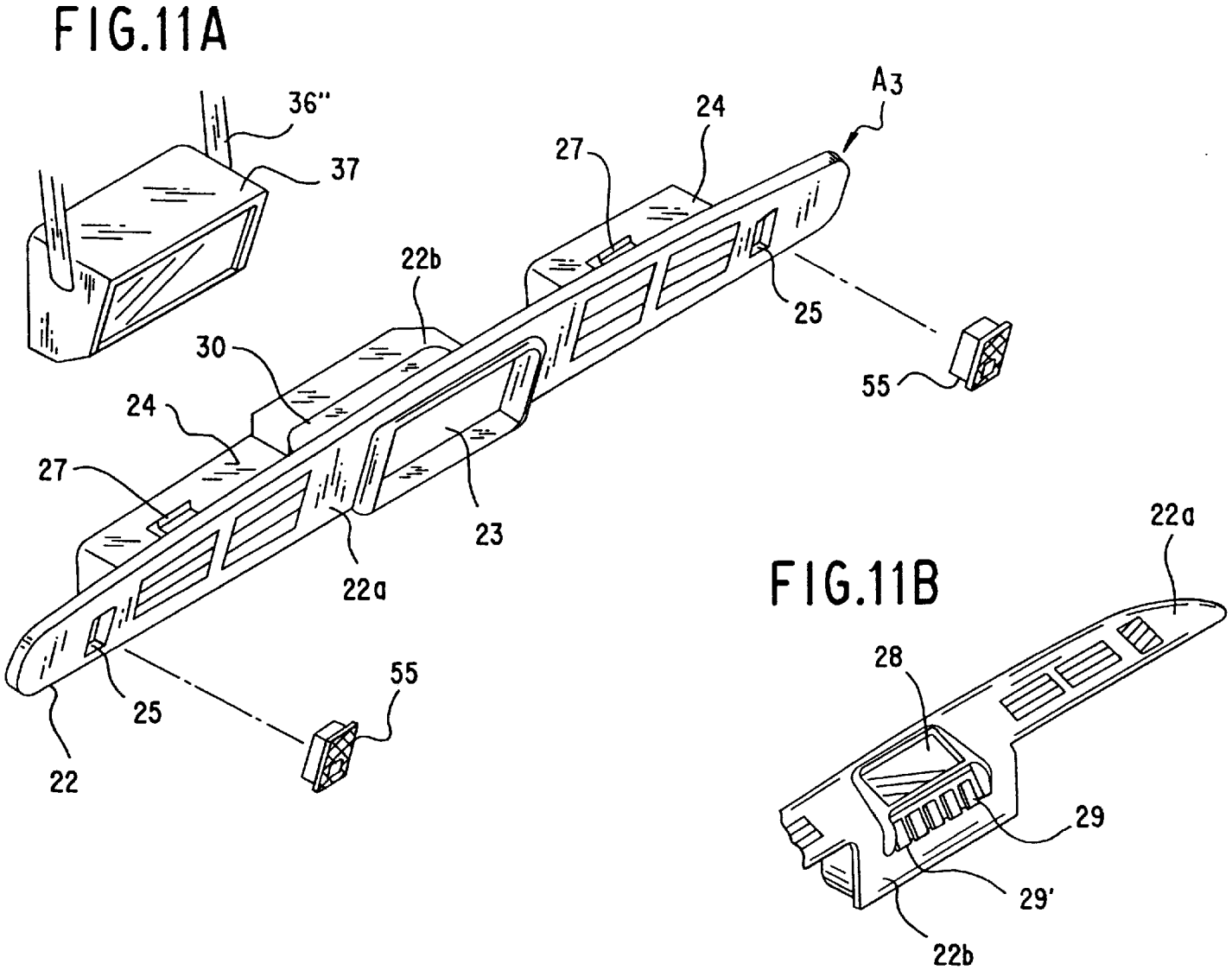
FIG. 11 is an enlarged perspective view showing a bezel 22 of FIG. 9.
Figure 12:
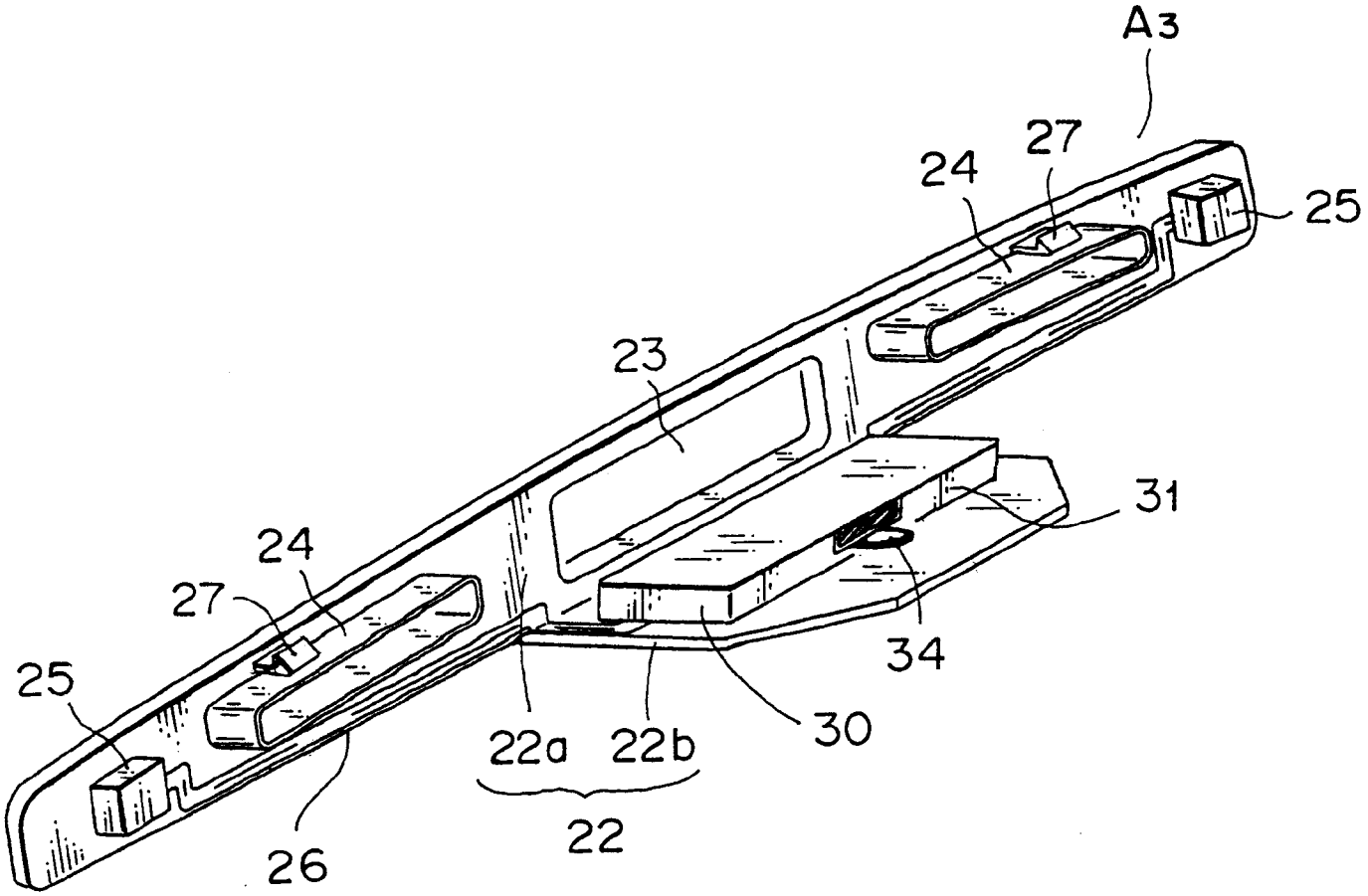
FIG. 12 is a perspective view as seen from a reverse side of the bezel of FIG. 11.

As shown in FIGS. 11 and 12, the electrical appliance module $A_3$ is a kind of control panel in which a control unit 30 is provided at the rear surface of the bezel which is made of synthetic resin. A female type connector 31 as the coupling section toward the receptive connector $C_3$ is provided for the control unit 30.

Namely, the bezel 22 is composed of the bezel body 22*a* and an inclined supporting board 22*b* extending from a low end edge to rearward oblique down direction. The control unit 30 is arranged between the bezel body 22*a* and the inclined supporting board 22*b*.

A window 23 for the television is provided at the front center of the bezel body 22*a*. On both side of the window 23, a duct cover 24 is integrally formed with the bezel body 22*a*. A spot lump 55 is mounted on both side lump mounting windows 25. The FPC 26 connected to the control unit 30 is arranged at the rear surface of the bezel body 22*a*. The pointed end of the FPC 26 is extending to the lump mounting window 25. Further, a locking projection 27 is formed on both sides of upper end edges of the bezel body 22*a*, so that the locking projection 27 engages with the window 21*a* of the molding roof 21, thus locking with each other.

On the other hand, there are provided an information display section 28 and switches such as an air conditioner switch 29, sun roof switch 29, and so forth. The information display section 28 displays road information, route guidance, weather information, sightseeing guidance, and public facilities.

The print circuit board 59 for integrating a micro computer for controlling various kinds of switches, air conditioner, sun roof, and room lights is accommodated on the inside of the unit case 30*a* of the control unit 30, and the female type connector 31 is integrally provided at the rear section of the unit case 30*a*.

Figure 13C:
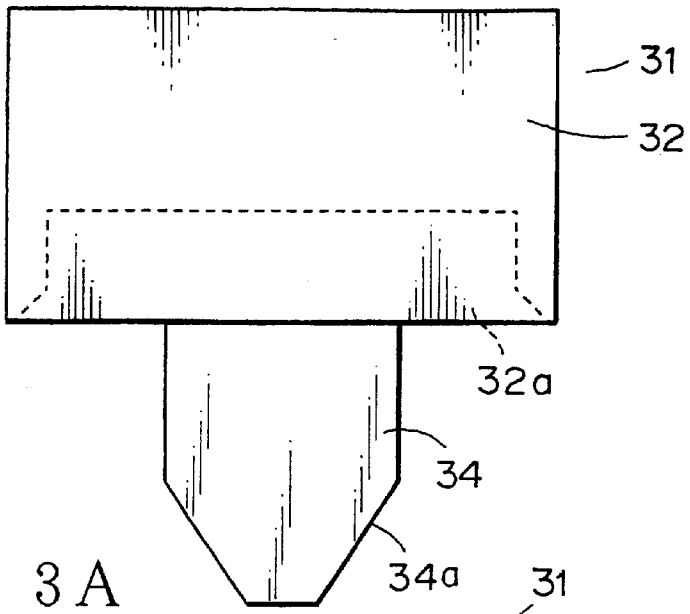
FIG. 13C is a plan view showing a female connector 31 which is the coupling section of the electrical appliance module A3 of FIG. 9.
Figure 13B:
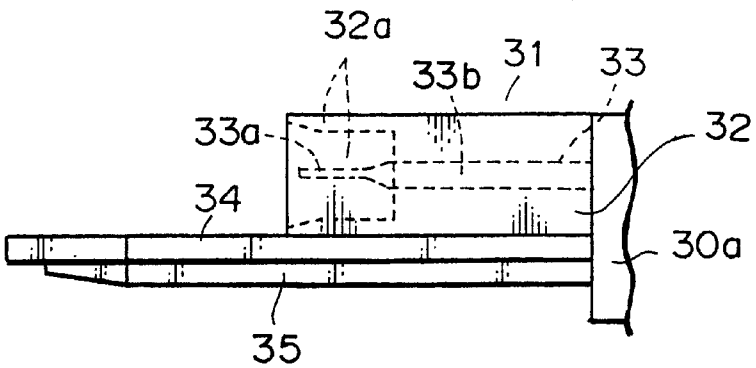
FIG. 13B is a side view showing a female connector 31 which is the coupling section of the electrical appliance module A3 of FIG. 9.
Figure 13A:
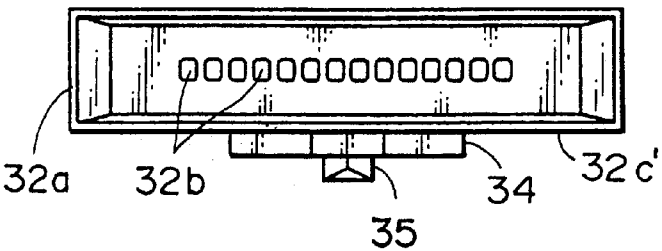
FIG. 13A is an elevation view showing a female connector 31 which is the coupling section of the electrical appliance module A3 of FIG. 9.

As shown in FIGS. 13A–13C, a hood 32*a* for receiving the receptive connector $C_3$ is provided at the pointed end side of the connector case 32. A plurality of terminal receiving chamber are provided on the inside thereof. 33 indicates a male terminal. In front thereof is a tab section 33*a* which is positioned on the inside of the hood 32*a*, and rear section thereof is a lead connecting section 33*b* which is received to be locked with the terminal receiving chamber 32*b*. The lead connection section 33*b* is fixedly connected using the lead line 58 for connecting to the circuit conductor (not illustrated) of the printed circuit board 59 by means of soldering. Further, a board shape introducing projection 34 which has tapered section 34*a* on both sides of the pointed end to rearward from the case at the bottom wall 32*c* of the connector case 32 is protruded. A fine positioning projected line is provided at the center of the bottom surface of the introducing projection 34.

As shown in FIGS. 9 and 10, the roof air conditioner unit D is fixed to the under surface of the body roof section R through the front and rear bracket 36, 36'. The television 37 is hung from the body roof through the bracket 36".

Figure 15:
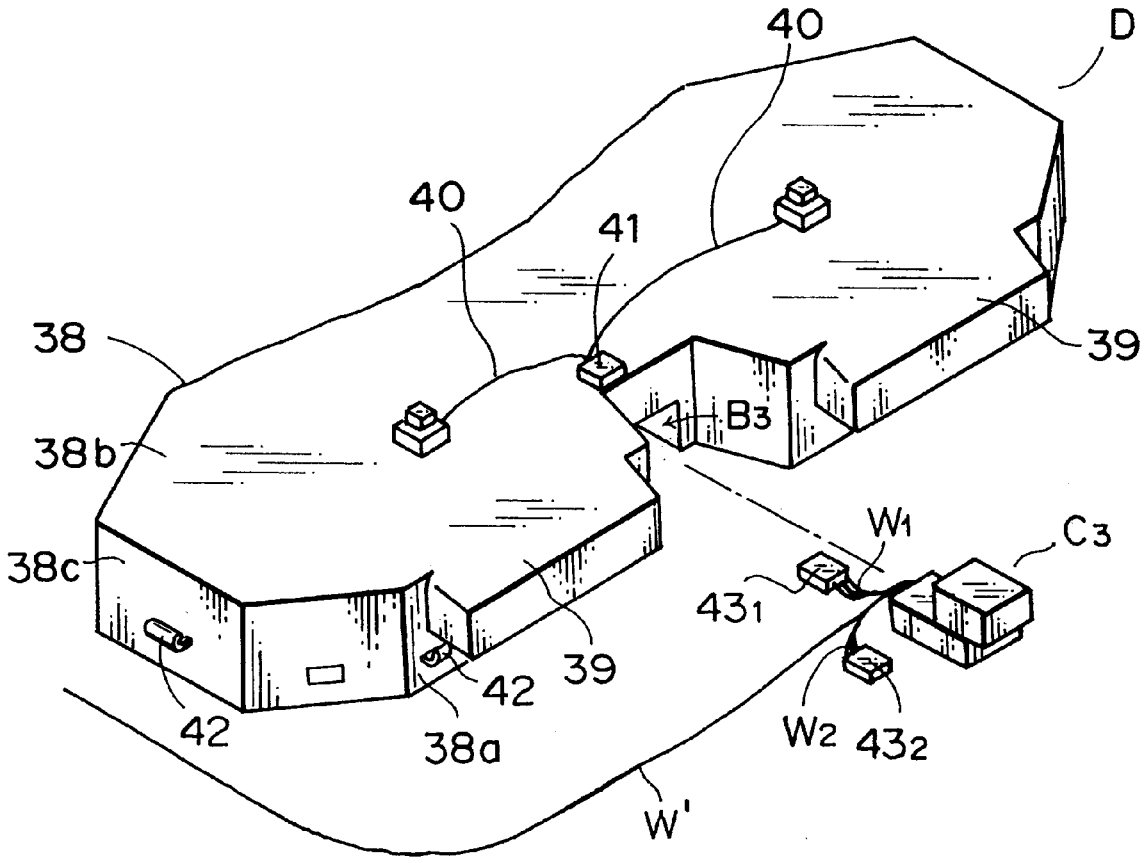
FIG. 15 is a perspective view showing a roof air conditioner unit D and a roof wire harness W' of FIG. 9.
Figure 16A:
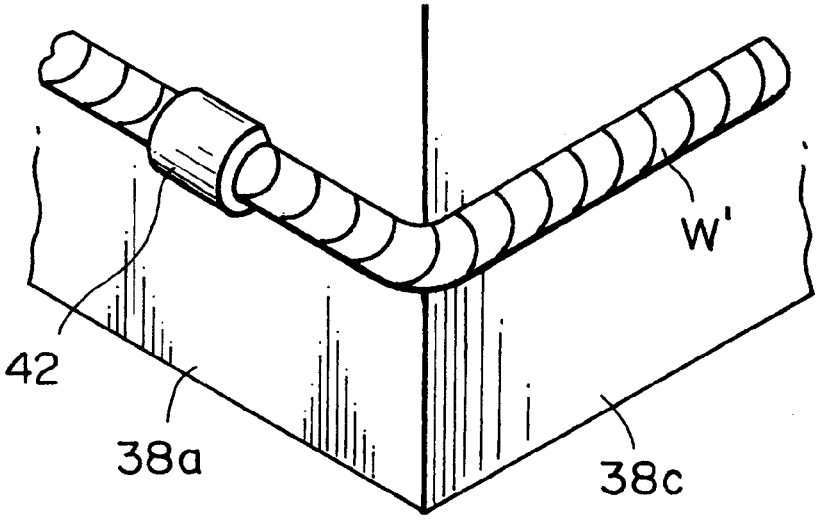
FIG. 16A is a principal portion perspective view showing a mounting structure of the roof wire harness W' to the roof air conditioner unit D of FIG. 15.
Figure 16B:
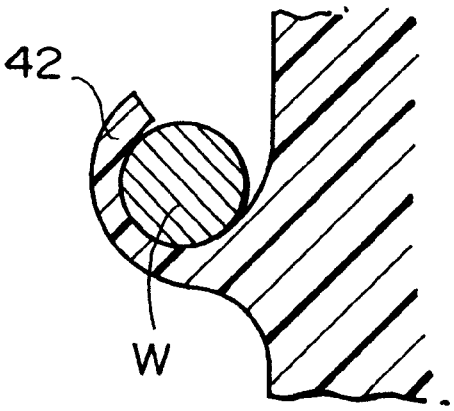
FIG. 16B is a fragmentary sectional view of FIG. 16A.

The roof air conditioner unit D is shown in FIGS. 15 and 16A, 16B. Middle of the roof air conditioner unit is narrow, and both sides thereof are round. The roof air conditioner unit D has large dumbbell shaped unit case 38. Ducts 39, 39 are formed at right and left sides of the front wall 38*a* of the case 38. Electrical machinery and apparatus such as blower motor, blower fun or the like and accessory equipments such as evaporator or the like which are not illustrated are mounted on both of the inside thereof. An aggregation connector 41 which is connected to electrical wiring 40, 40 of the electrical machinery and apparatus is provided at the center of the upper wall 38*b*. Further a plurality of wire hook 42 are integrally provided at the wall surface from the side wall 38*c* to the front wall 38*a* of the unit case 38. The roof wire harness W' is arranged to be fixed by the wire hook 42 along the peripheral wall of the unit case 38.

The terminal of the roof wire harness W is connected to the receptive connector $C_3$. Connectors $\mathbf{43}_1$, $\mathbf{43}_2$ are mounted on two pieces of branch wires $W_1$', $W_2$' thereof each. The connector $\mathbf{43}_1$ is connected to the aggregation connector 41 and another connector $\mathbf{43}_2$ is connected to the connector (not illustrated) of the television 37.

The connector accommodating section $B_3$ for positioning to fix the waiting connector $C_3$ is provided at under surface of the narrow section of the center of the unit case 38. Flange fitting groove 46 is provided along the inside wall 45. The flange fitting groove 46 continuously formed at right and left side wall 45*a* and the upper wall 45*b*.

Figure 14B:
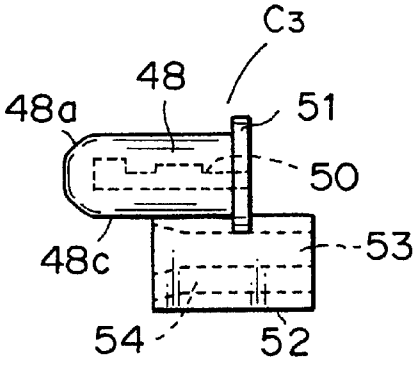
FIG. 14B is a side view showing the receptive connector $C_3$ of FIG. 10.
Figure 14C:
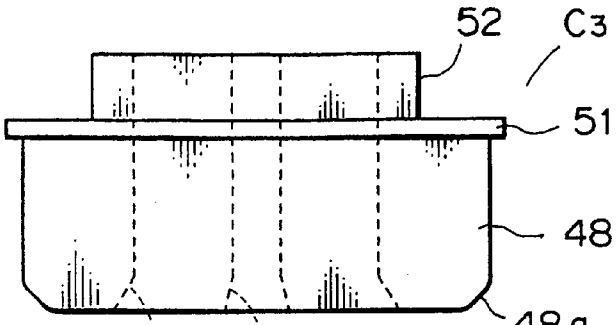
FIG. 14C is a plan view showing the receptive connector $C_3$ of FIG. 10.
Figure 14A:
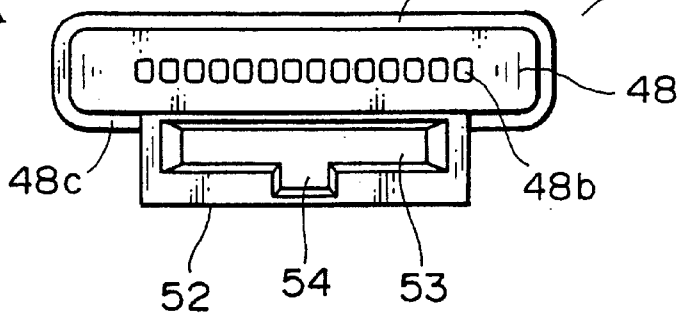
FIG. 14A is an elevation view showing the receptive connector $C_3$ of FIG. 10.

The receptive connector $C_3$ is formed as the male type connector corresponding to the female type connector 31. As shown in FIGS. 14A–14C, a guide tapered section 48*a* is formed at outer periphery of the pointed end section of the fitting section corresponding to the female type connector 31 of the connector case 48. Female terminal 50 (referring to FIGS. 19, 20) is receive to be locked to the roof wire harness W' in the plurality of terminal receiving chambers 48*b* which are provided therein in parallel with each other.

Furthermore, Flange 51 is provided at outer periphery of the rear end section of the connector case 48. Frame shaped module mounting section 52 is integrally formed with the bottom wall 48*c*. The module mounting section 52 is projected to be formed from the second half of the bottom wall 48*c* to the rear end surface of the connector case 48. Fitting hole 53 corresponding to the introducing projection 34 of the female type connector 31 and fitting groove 54 corresponding to the positioning projection 35 are continuously provided inward. Guide tapered sections 53*a*, 54*a* are formed at the entrance section of both of the fitting hole 53 and fitting groove 54. The guide tapered sections 53*a*, and 54*a* are gradually expanded toward the pointed end.

Figure 17:
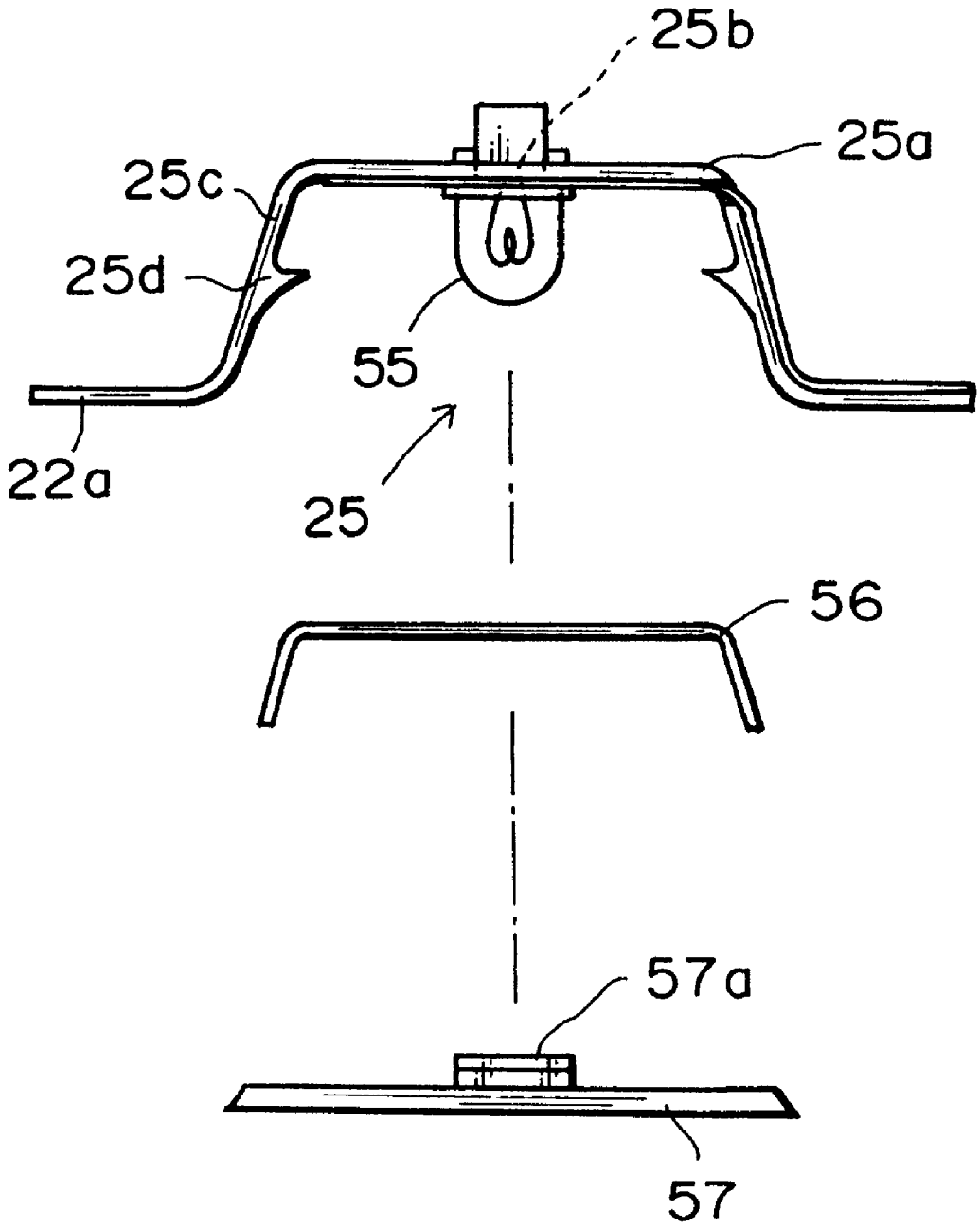
FIG. 17 is an elucidative view showing the mounting structure of a spot lamp 55 of FIG. 9.

FIG. 17 shows the mounting structure of the spot lump 55 to the bezel 22. Namely, the lump mounting window 25 of the bezel body 22*a* has lump pushing hole 25*b* at the bottom wall 25*a*. Locking projection 25*d* is provided at inclined peripheral wall 25*c* as an earthenware mortar. The spot lamp 55 is thrusted to be fixed from the front side of the bezel body 22*a* to the lump pushing hole 25*b*, before fitting reflecting board 56 and locking by means of the locking projection 25*d*. plastic lens 57 is covered thereon, and it allows the locking projection 57*a* of the lens to engage to locking groove which is not illustrated of the peripheral wall 25*c*.

Figure 18A:
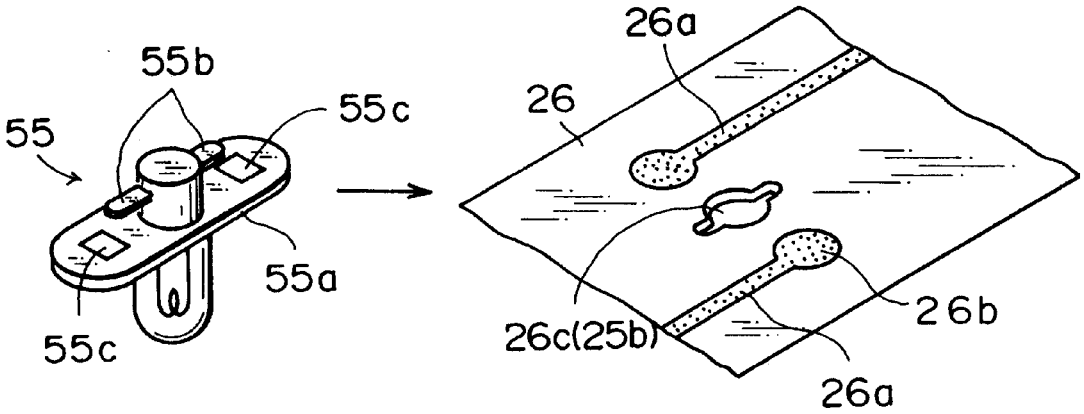
FIG. 18A is a perspective view showing mutual relation between the spot lamp 55 and FPC 26.
Figure 18B:
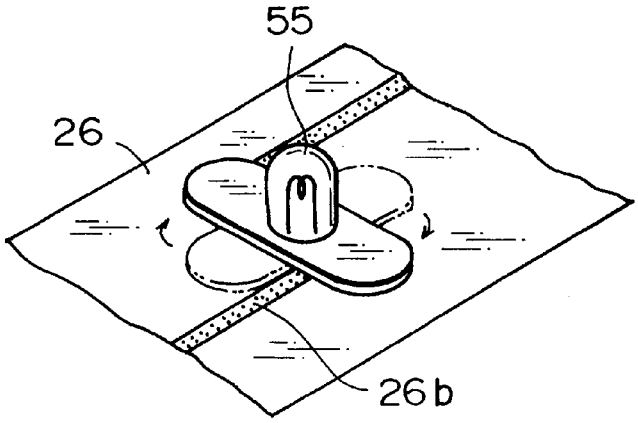
FIG. 18B is a perspective view showing a mounting condition of FIG. 18A.

FIGS. 18A, 18B show a fixing structure and an electrical connecting structure of the spot lamp 55.

As shown in FIG. 18A, the spot lamp 55 has a wing shaped mounting board 55*a* in the middle section thereof, a locking pin 55*b* on both sides of rear end. A pair of electrodes 55*c* are provided at a rear surface of the mounting board 55*a*.

On the other hand, the EPC 26 from the control unit 30 is arranged and fixed at the bottom wall 25*a* of the lamp mounting window 25. The same hole as the lamp pushing hole 25*b* is provided at the intermediate portion of the lands 26*b*, 26*b* of a pair of circuit conductor 26*a*.

As shown in FIG. 18B, the lamp pushing hole 25*b* is aligned with the locking pin 55*b* of the spot lamp 55 from the bezel 22, before inserting. If the spot lamp turns 90° as an arrow line, the spot lamp 55 is locked, and the electrode 55*c* comes into contact with the land 26*b*, thus being connected electrically.

Thus, the mounting of the spot lamp 55 is capable of performing very simply.

Next, the assembling of the roof air conditioner assembly-body E, the arrangement of the roof wire harness W', and assembling method of the electrical appliance module $A_3$ in which it causes the receptive connector $C_3$ to mount to the connector accommodating section $B_3$ of the roof air conditioner unit D, will be elucidated.

As shown in FIG. 10, the roof air conditioner unit D is fixed to the body roof section R through the brackets 36, 36'. As shown in FIGS. 15, 16, the roof wire harness W' is wired using the wire hook 42 provided at the unit case 38. The connector $\mathbf{43}_1$ of the terminal of the branch wire W' is engaged to be connected to aggregation connector 41 for the air conditioner. Moreover, and it allows the flange 51 of the receptive connector $C_3$ to match to the flange fitting groove 46 at the connector accommodating section $B_3$ and to push upward to be engaged, before fixing the receptive connector by the screw to the unit case 38.

Next, the television 37 is fixed in front of the roof air conditioner unit D through the bracket 36", before mounting the molded roof 21 on the body roof section R, thus covering the unit D and the television 37.

Figure 19:
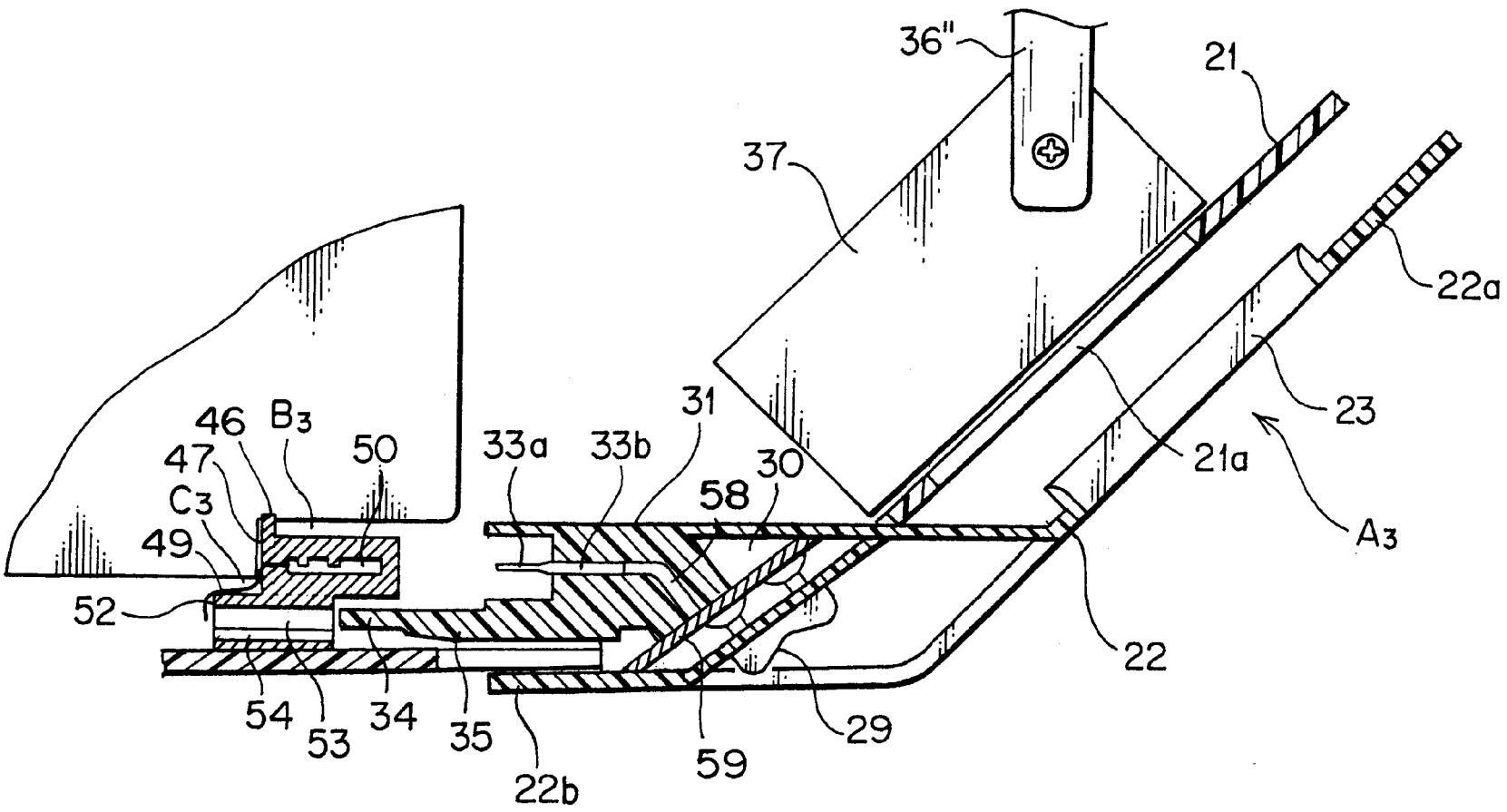
FIG. 19 is a principal portion sectional view showing before connection between the electrical appliance module A3 and the receptive connector $C_3$.

As shown in FIG. 19, the bezel 22 of the electrical appliance module $A_3$ is opposite to the window 21*a* of the molded roof 21. The inclined supporting board 22*b* is provided along wall surface of the molded roof 21. The introducing projection 34 of the module mounting section 52 of the receptive connector $C_3$ is opposite to the positioning projection 35 of the female connector 31. It allows the electrical appliance module $A_3$ to push into as an arrow line.

For this reason, the introducing projection 34 arrives at the engaging hole 53 of the module mounting section 52. The introducing projection 34 enters smoothly into the inner section due to the mutual tapered section 34*a* and the insertion guide section 53*a*. Next the positioning projection 35 enters into the engaging groove 54 due to the fine shape of the introducing projection 34 and the insertion guide section 54*a*. The electrical appliance module $A_3$ is guided and positioned by the module mounting section 52, thus entering smoothly.

Figure 20:
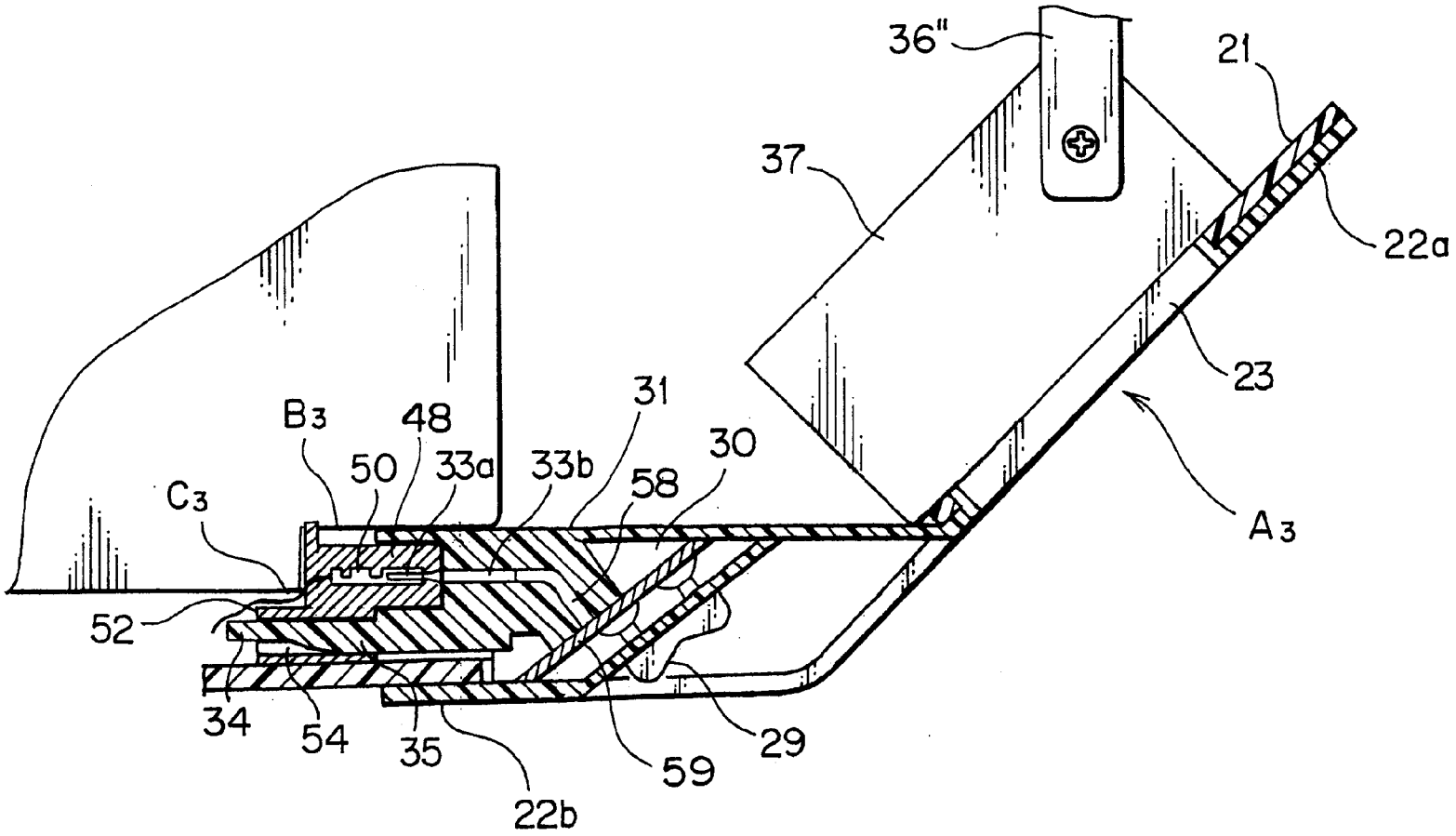
FIG. 20 is a principal portion sectional view showing connecting condition of FIG. 19.
Figure 21:
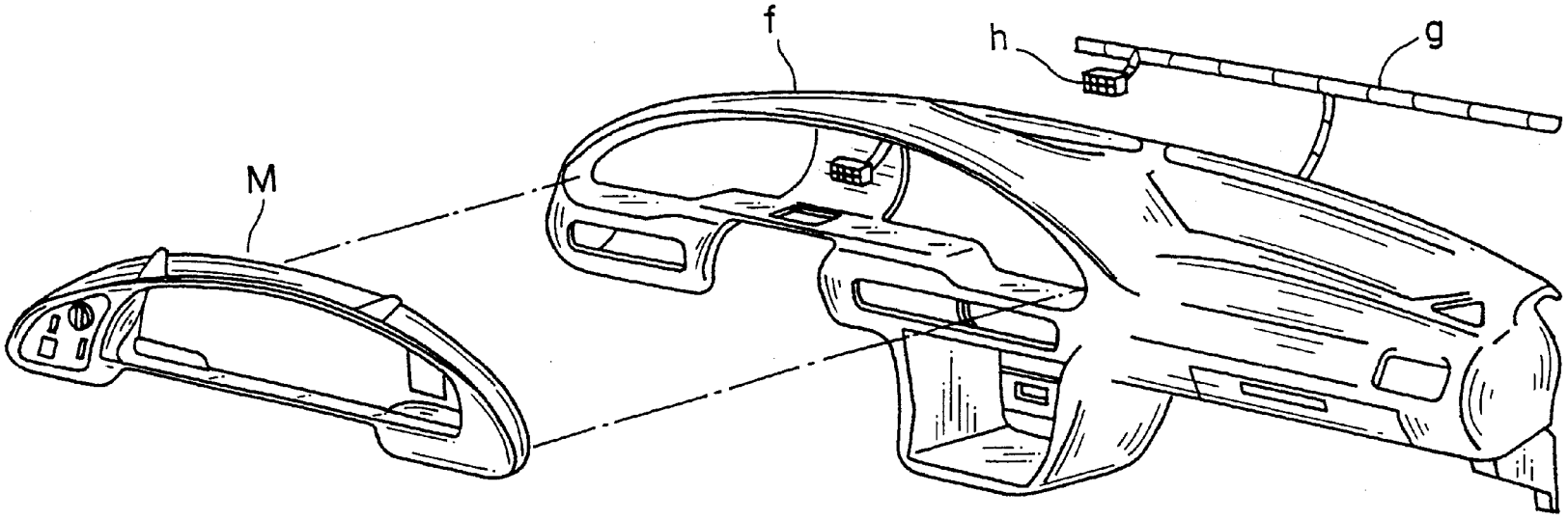
FIG. 21 PRIOR ART
FIG. 21 is a perspective view showing a conventional meter module being separated.
Figure 22:
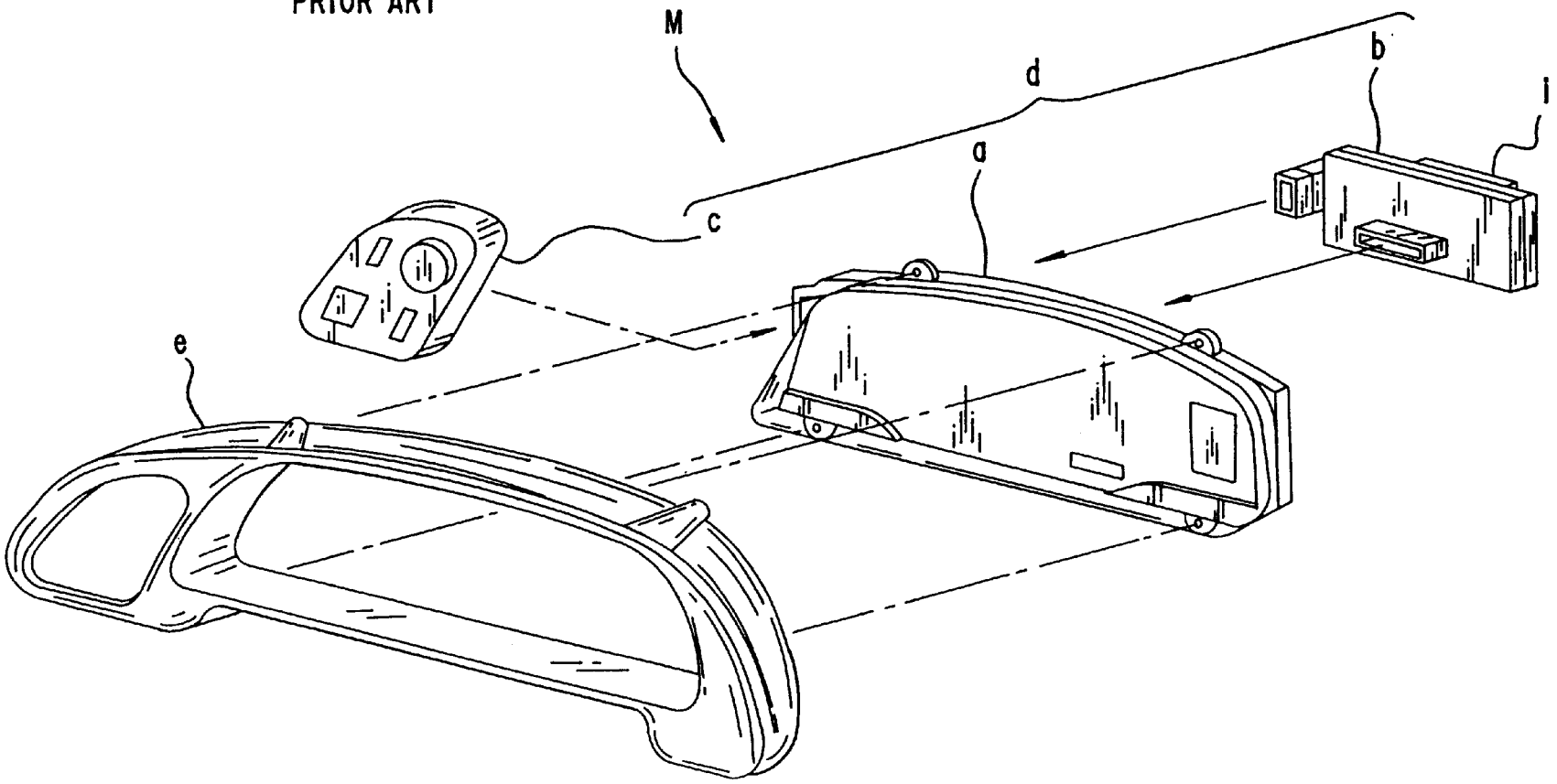
FIG.22 PRIOR ART
FIG. 22 is a perspective view showing a process where it allows the meter module to assemble to the dash board of FIG. 21.

Lastly, as shown in FIG. 20, the connector case 48 of the receptive connector $C_3$ is engaged with the inside of the hood 32*a* of the female connector 31. The male terminal 33 is inserted into the female terminal 50. Both the connectors $C_3$ and 31 are connected electrically. The locking projection 27 (referring to FIG. 11) is locked to the window 21*a* of the molded roof 21, thus locking each other.

As stated above, the roof wire harness W' is capable of being arranged to be fixed easily utilizing the unit case 38 of the roof air conditioner unit D. Further, the receptive connector $C_3$ is easily fixed due to providing the connector accommodating section $B_3$ for the unit case 38. Mechanical and electrical connections of the electrical appliance module $A_3$ are performed simultaneously due to the mutual guide-operation of the module mounting section 52, the introducing projection 53 of the female connector 31, and the positioning projection 54. According to the present invention, the connector accommodating section is provided at the vehicle on board equipment such as the instrument panel and so forth. The module mounting section is provided at the receptive connector inserted into the connector accommodating section. The positioning of the mounting for the electrical appliance module is easy. The assembling and the connecting of the electrical circuit between the receptive connector and the electrical appliance module smoothly and surely performed. The productivity of the assembling process and reliability are greatly improved. It can be adapted to the automatic assembling process because of the simplification of the assembling process so that there are large advantages.

While preferred embodiments of the invention have been described using specific terms, such description is for illustrative purposes only, and it is to be understood that changes and variations may be made without departing from the spirit or scope of the following claims.

What is claimed is:

1. An assembling structure for installing an electrical appliance module including switches, lamps, measuring instruments, and an electrical circuit for controlling said switches, lamps or measuring instruments in a vehicle on board equipment such as an instrument panel, and being connected to a receptive connector of a wire harness, comprising:

a connector accommodating section provided at said vehicle on board equipment for fixing said receptive connector thereto;

a module mounting section projected over a connector case of said receptive connector for fixing said electrical appliance module thereto;

a coupling section provided on a case of said electrical appliance module to be coupled with said receptive connector; and a grooved guide member provided on said case of said electrical appliance module for guiding by engaging with said module mounting section after said receptive connector is mounted on said connector accommodating section, and wherein said electrical appliance module is not mounted to the connector accommodating section, wherein said grooved guide member provided on said case of said electrical appliance module is moved to permit insertion of said module mounting section thereinto thereby assembling said electrical appliance module to said vehicle on board equipment, and at least one first terminal provided at said coupling section of said electrical appliance module is brought into contact with at least one second terminal of said receptive connector.

2. The assembling structure for installing an electrical appliance module according to claim 1, wherein said module mounting section of said receptive connector is formed as a board-shaped introducing projection and said grooved guide member of said electrical appliance module is formed as an inserting groove for receiving said introducing projection, and said introducing projection enters into said inserting groove prior to connection-start between said receptive connector and said coupling section since said introducing projection is projected in front of said connector case of said receptive connector.

3. An assembling structure for installing an electrical appliance module according to claim 1, wherein said vehicle on board equipment is a unit case of a roof air conditioner unit which is fixed to the body roof section.

4. An assembling structure for installing an electrical appliance module according to claims 1 or 3, wherein said guide member of said electrical appliance module is formed as the board shaped introducing projection, and said module mounting section of said receptive connector is formed as a fitting hole for receiving said introducing projection, as said introducing projection enters into said fitting hole, prior to connection-start between said receptive connector and said coupling section, said introducing projection is projected to be formed in front of said case of said electrical appliance module.

5. An assembling structure for installing an electrical appliance module according to anyone of claims 1 or 3, wherein said receptive connector is formed as a male type connector receiving female terminals, and said coupling section of said electrical appliance module is formed as a female type connector receiving male terminals corresponding to said female terminals.

6. An assembling structure for installing an electrical appliance module according to anyone of claims 1 or 3, wherein said vehicle on board equipment is fixed to the body roof section through the brackets.

7. The assembling structure for installing an electrical appliance module according to claim 1, wherein said connector accommodating section equips a guide projection, and said connector case of said receptive connector equips a guide groove such that when said guide projection is inserted into said guide groove, said receptive connector is fixed to said connector accommodating section.

8. The assembling structure for installing an electrical appliance module according to claim 7, wherein said guide groove of said receptive connector has a tapered section which extends toward said connector accommodating section.

9. The assembling structure for installing an electrical appliance module according to claim 7, wherein said module mounting section of said receptive connector is formed as a board-shaped introducing projection and said grooved guide member of said electrical appliance module is formed as an inserting groove for receiving said introducing projection, and said introducing projection enters said inserting groove prior to connection-start between said receptive connector and said coupling section since said introducing projection is projected in front of said connector case of said receptive connector.

10. The assembling structure for installing an electrical appliance module according to claims 1, 7, 2, 8 or 9, wherein said first and second terminals consist of surface-contact type terminals and said receptive connector mounts a plurality of said surface-contact type terminals on an upper wall of said connector case, and said electrical appliance module equips said surface-contact type terminals with an elastic contact piece on the coupling section provided at the case.

* * * * *